US006173784B1

(12) United States Patent
Shaposhnikov et al.

(10) Patent No.: US 6,173,784 B1
(45) **Date of Patent: *Jan. 16, 2001**

(54) METHOD AND DEVICE FOR PRODUCTION OF HYDROCARBONS

(75) Inventors: Vladimir M. Shaposhnikov, Brooklyn; Semen D. Tseytlin, Middle Village, both of NY (US)

(73) Assignee: Petro Energy, L.L.C., New York, NY (US)

( * ) Notice: Under 35 U.S.C. 154(b), the term of this patent shall be extended for 0 days.

This patent is subject to a terminal disclaimer.

(21) Appl. No.: 09/080,473

(22) Filed: May 18, 1998

Related U.S. Application Data

(63) Continuation of application No. 08/742,409, filed on Nov. 4, 1996, now Pat. No. 5,752,570.

(51) Int. Cl.[7] ..... E21B 43/12
(52) U.S. Cl. ..... 166/372; 166/321
(58) Field of Search ..... 166/372, 321, 166/162, 311, 369, 371, 105.5

(56) References Cited

U.S. PATENT DOCUMENTS 4,390,061 * 6/1983 Short ..... 166/53
5,105,889 * 4/1992 Misikov et al. ..... 166/372
5,707,214 * 1/1998 Schmidt ..... 417/109
5,752,570 * 5/1998 Shaposhnikov et al. ..... 166/372

* cited by examiner

*Primary Examiner*—William Neuder
*Assistant Examiner*—Zakiya Walker
(74) *Attorney, Agent, or Firm*—William D. Durkee

(57) ABSTRACT

Hydrocarbons are produced from a well having a bottomhole and a wellhead and communicating with a formation, by producing a flow of hydrocarbon-containing formation fluid from the formation at the bottomhole of the well, transforming the flow of the formation fluid from the formation at the location of transformation into a finely-dispersed gas-liquid flow with a liberated gas forming a part of the gas-liquid flow, so that a column of the formation fluid is formed in the well from the depth of the formation to the location of transformation, and a column of the finely-dispersed gas-liquid flow with a liberated gas is formed in the well between the location of the transformation and the wellhead, and automatically maintaining a pressure of the formation fluid at the bottomhole in the well higher than saturation pressure, substantially independently from changes in properties of formation and formation fluid.

11 Claims, 3 Drawing Sheets

METHOD AND DEVICE FOR PRODUCTION OF HYDROCARBONS

This application is a continuation of pending U.S. application Ser. No. 08/742,409, filed Nov. 4, 1996, which issued as U.S. Pat. No. 5,752,570 on May 19, 1998.

TECHNICAL FIELD

The present invention relates to a method of and a device for production of hydrocarbons, in particular oil from wells.

BACKGROUND ART

Various methods and devices are known for production of hydrocarbons from wells. One such method is a natural flow method of production of hydrocarbons from wells according to which a formation fluid flows from the bottomhole to the wellhead of a well due to oil formation pressure and energy of gas dissolved in oil. In course of operating the well using said method, formation pressure drops until it is insufficient for lifting oil to the wellhead, and the well stops operating. In that case a common mechanical method of oil production is used, for example, a gas-lift method. Maximum flow rates lead to a decrease in bottomhole pressure. However, the decrease in bottomhole pressure below saturation pressure results in oil degassing in the near-bottomhole zone of the formation, clogging of porous space of the reservoir by gas, and, consequently, in a decrease in oil production. To prevent this effect, at the wellhead is generated counter-pressure by means of a choke with its inner diameter selected so as to provide required bottomhole pressure, which may result in a certain limitation of oil flow rate. However, such maintenance of bottomhole pressure at a level not lower than saturation pressure, performed from the site of the wellhead, also may stop the flow regime of the well and cause the necessity to use a gas-lift or pumping method of oil production.

According to the gas-lift method of oil production, a compressed gas is injected at a certain depth into the production tubing to aerate the formation fluid in the tubing upon a decrease in well pressure due to lifting of the flow, hereby reducing the fluid's weight, so that the aerated fluid flows up towards the wellhead, and the bottomhole pressure reduces. At the same time, the difference between the formation pressure and the bottomhole pressure increases and oil starts to flow from the formation through the well from its bottomhole to the wellhead. The main disadvantage of this method is high production costs due to increased oil well operating expenses, including expenses for gas, compressor equipment, pumping energy, control systems. Besides, efficiency of the gas-lift method is relatively low.

Another method of oil production is disclosed in a U.S. Pat. No. 5,105,889. According to this method of oil production from wells with a reduced formation pressure, gas dissolved in oil is forcedly liberated from the oil flow at the bottomhole part of a well, and the oil flow is hereby transformed into a finely-dispersed gas-liquid flow so, that the pressure of gas-liquid column from the site of the transformation to the wellhead, in sum with the wellhead pressure, less friction losses, becomes lower than the saturation pressure and lower than the difference between the bottomhole pressure and the pressure of the fluid column from the depth of the formation occurrence to the location of said transformation. In case of such oil transformation in a well, oil lifting to the wellhead occurs due to energy of gas dissolved in oil, without any additional energy sources, even in wells with a reduced formation pressure. According to this method, to prevent oil degassing in the bottomhole zone of the well and consequent decrease of oil production, the bottomhole pressure is established and maintained to be higher than the saturation pressure by means of throttling; at the same time, the inner cross section of the flow channel is reduced and flow speed consequently increased to reduce the flow pressure below the saturation pressure, hereby forcing degassing in the whole fluid column of the well. A device for performing this method consists of a body with a nozzle installed in the body and aligned with the well, which body is fixed hermetically in a compressor tube, and Venturi tubes installed in the body above the nozzle and aligned with it, for forced liberation of a gas dissolved in the formation fluid and transformation of the flow coming out of the nozzle into a finely dispersed gas-liquid flow. In this device said venturi tubes are installed in the upward sequence and aligned.

The above method is more advanced than gas-lift, since it provides creation in a well of a gas-liquid flow of lower density; stabilization of bottomhole pressure, preventing of oil degassing in the formation and at the well bottomhole; maintenance of the wellhead pressure at a level providing gas-liquid flow to the wellhead and preventing its phase separation, to hereby prolong or restore flowing regime of the well without any additional energy sources, to reduce operational costs, and to increase efficiency of oil production in general.

During the process of oil production various hydrodynamic and gas dynamic changes occur which influence the work of producing wells, such as a drop in the formation pressure due to oil intake from a reservoir, which results in a reduction of well flow rates; a drop in the formation pressure due to interference to changes occurring in adjoining wells, such as stoppage of a well for repair, introduction of a new well, etc. which also results in a reduction of oil production; a reduction of gas content in the oil, an increase of water content in the production; a depletion of separate formation layers, which also leads to a decrease in well flow rates; junction of cracks together in porous reservoirs in the bottomhole zone of the formation; an increase in the formation pressure due to pumping of water down injection wells, etc. All said natural and technogenic processes occur at deposits all the time and affect well operation to some or the other degree. If said changes, occurring irregularly at different deposits and wells, are not taken in consideration, it may lead to a drop in the formation pressure, a decrease in the formation pressure gradient; a drop in the bottomhole pressure below the saturation pressure, a water/oil ratio increase, a change in the gas content and the saturation pressure, which consequently may result in a reduction of well flow rate, an expeditious gas break through wellbore flow, an unstable working regime of the wells, even the production shutdown of the wells. In the event of the above, it will be necessary to use more expensive and less efficient secondary mechanical methods of oil production.

According to the method disclosed in the described above U.S. patent, it is possible to partially control said processes by means of a bottomhole and a wellhead facilities: a wellhead valve which automatically regulates the proportion of gas-liquid mixture from the site of its origination in the well to the wellhead, preventing creation of an annular mist flow regime, and the bottomhole device which permits correction of the well operation if any changes occur, by means of periodical replacement of Venturi tubes in the device with the new ones with different parameters in correspondence with any changes in properties of the formation and the formation fluid, for example, changes in bottomhole pressure, gas and water content in the flow, well flow rate, and so on. Operation of a well stops during such replacements, additional expenses on the replaced equipment occur, well operation becomes more complicated and less efficient due to step-by-step change of the device parameters.

DISCLOSURE OF THE INVENTION

The object of this invention is to develop an efficient method of and a device for production of hydrocarbons, which avoid the disadvantages of the prior art.

In keeping with this object and with the others which will become apparent hereinafter, one feature of the present invention resides, briefly stated, in a method of production of hydrocarbons, in accordance with which a flow of a hydrocarbon-containing formation fluid is produced at the bottomhole of a well, the flow of the formation fluid is transformed at a location of transformation into a finely-dispersed gas-liquid flow, with a liberated gas forming a part of the gas-liquid flow, so that a column of the formation fluid is formed in the well from a depth of the formation to the location of transformation while a column of the finely dispersed gas-liquid flow with a liberated gas is formed in the well between the location of transformation and the wellhead, and in accordance with new features of the present invention, a pressure of the fluid column of the formation fluid at the bottomhole of the well is maintained automatically higher than a saturation pressure, substantially independently from changes in properties of the formation and formation fluid. Also, during the above-mentioned automatically maintaining step, a speed of the formation fluid flow below the location of transformation is maintained at a level providing transformation of the formation fluid flow into the finely-dispersed gas-liquid flow at the location of transformation.

In accordance with another feature of the present invention, the device for producing a hydrocarbon-containing formation fluid flow is proposed which includes appropriate means for producing a formation fluid flow at the bottomhole of the well, means for transforming the formation fluid flow at a location of transformation into a finely-dispersed gas-liquid flow, and in accordance with the inventive feature, means is provided for automatic maintaining pressure of the formation fluid column at the bottomhole higher than saturation pressure, substantially independently from changes in properties of the formation and formation fluid. The means of automatic maintaining can simultaneously maintain a speed of the formation fluid flow at a level providing the transformation of the formation fluid flow into the finely-dispersed gas-liquid flow with a liberated gas forming a part of the gas-liquid flow.

When the method is performed and the device is designed and applied in accordance with the present invention, they avoid the disadvantages of the prior art and provide highly advantageous results. In accordance with the invention, the bottomhole pressure is permanently maintained above the saturation pressure automatically, and therefore the bottomhole zone of the formation cannot be clogged by gas. At the same time, a stable gas-liquid flow is formed and maintained automatically from the location of the flow transformation to the wellhead, so that the well operates during a long period of time regardless of the changing conditions of the formation and the formation fluid, such as formation pressure, gas and water content of the flow, closing cracks in the bottomhole zone of the formation, etc. The maintenance of the bottomhole pressure and the stable gas-liquid flow is performed automatically while the inventive device stays installed in the well, so that no replacement of the installed device with a new one is needed. As a result, a continuity of the well operation and increase in oil production of the formation as a whole is obtained. The above-described control of the bottomhole pressure and the gas-liquid flow is performed in the bottomhole zone of the well between the bottomhole zone of the formation and the location of transformation of the formation fluid flow into the gas-liquid flow.

The novel features which are considered as characteristic for the present invention are set forth in particular in the appended claims. The invention itself, however, both as to its construction and its method of operation, together with additional objects and advantages thereof, will be best understood from the following description of specific embodiments when read in connection with the accompanying drawings.

BEST MODE OF CARRYING OUT THE INVENTION

Figure 1:
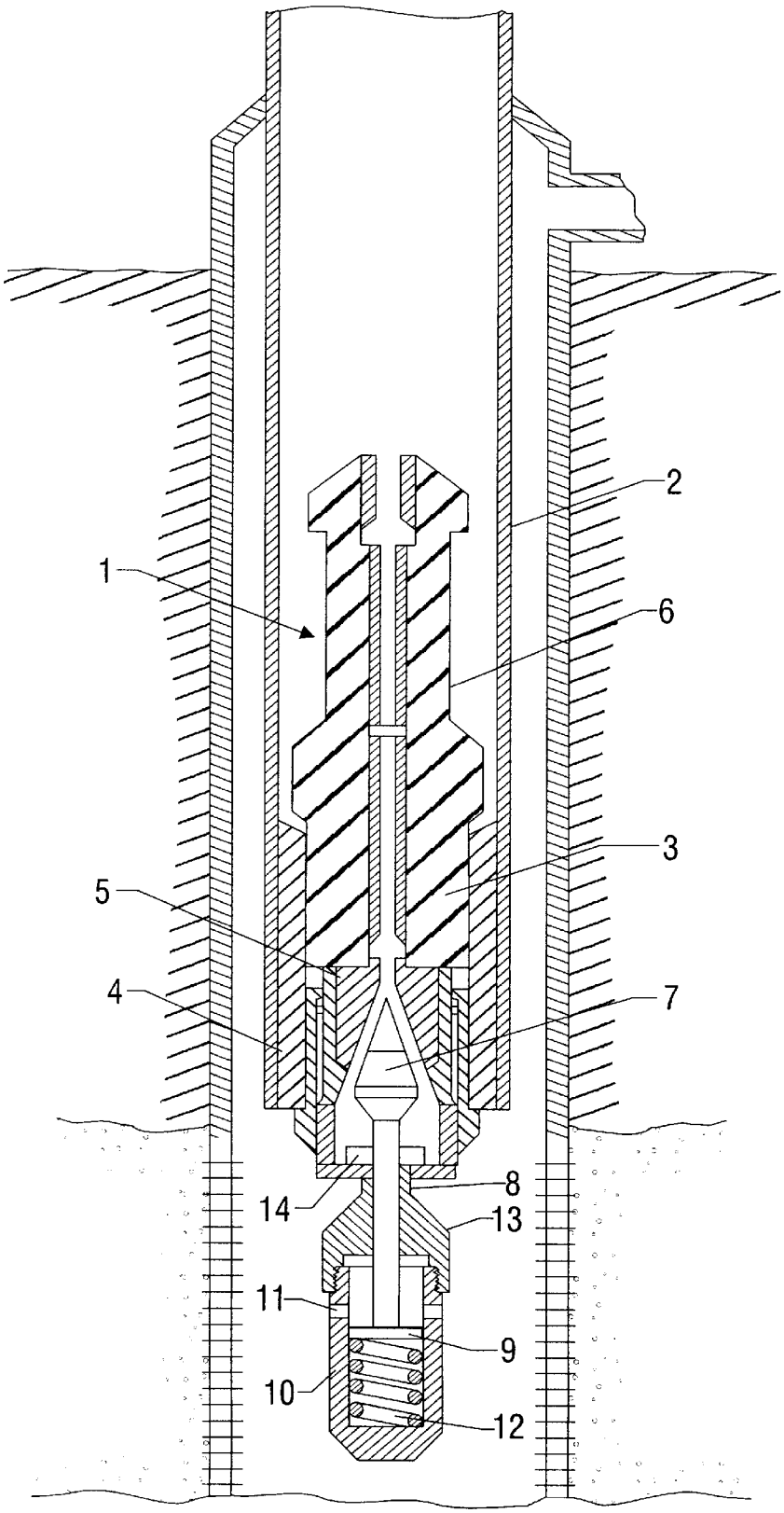
FIG. 1 is a view schematically showing a device for production of hydrocarbons in accordance with the present invention in a well.
Figure 2:
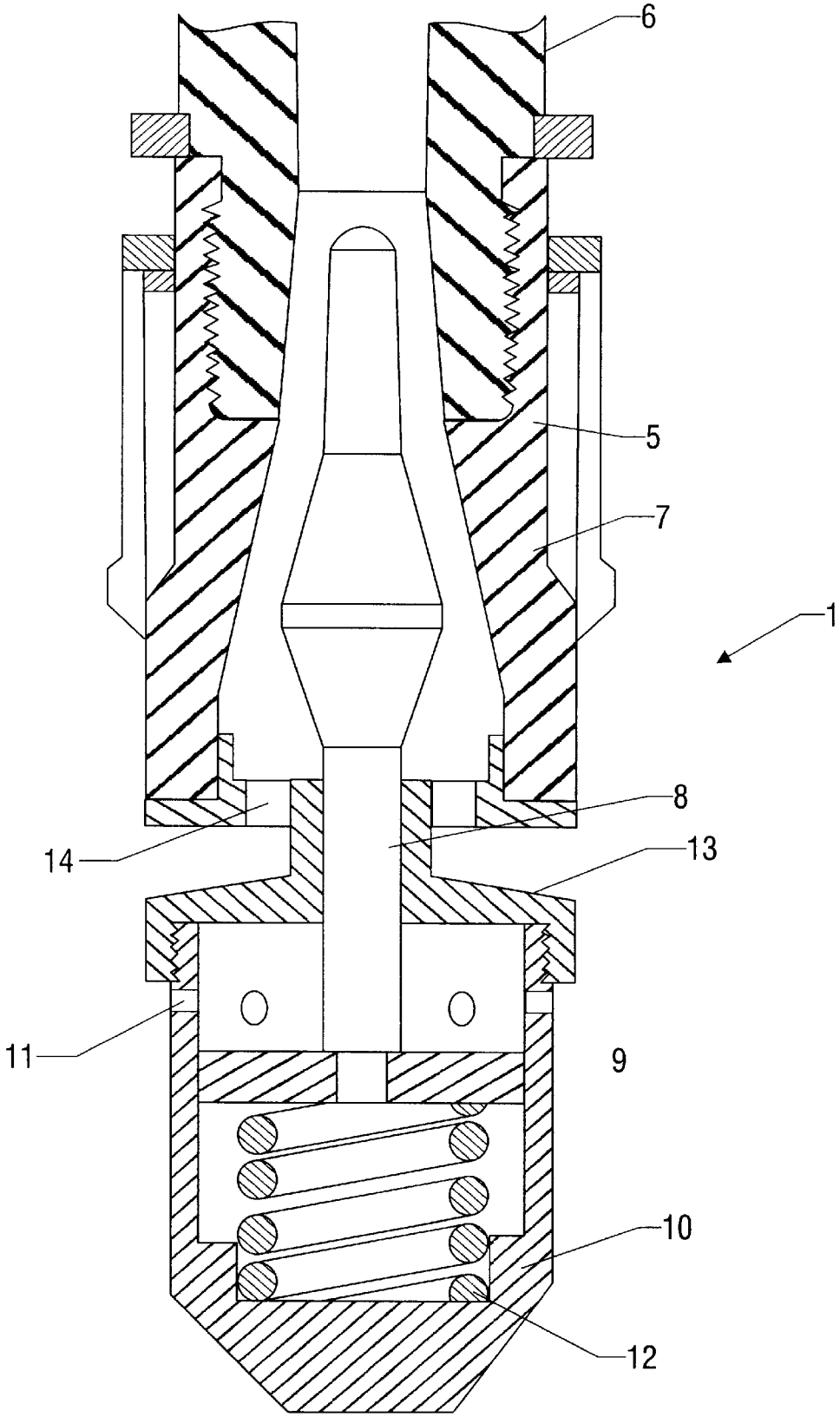
FIG. 2 is a view showing the inventive device for production of hydrocarbons on an enlarged scale.

A device for production of hydrocarbons in accordance with the present invention which is utilized to implement the inventive method of production of hydrocarbons is identified as a whole with reference numeral 1 and mounted in a compressor tube 2 of a well. In particular, a body 3 of the device 1 is hermetically secured in a seat 4 of the compressor tube 2 of the well. During operation of the well, the formation fluid flows from the formation through holes of an outer well tube into the bottomhole zone of the well to be transported to the wellhead. The device 1 is provided with means for transformation of the formation fluid into a finely-dispersed gas-liquid flow. The transformation means include a nozzle 5 and a Venturi flow means including a plurality of Venturi tubes 6 which form a channel expanding stepwise upwardly. The nozzle 5 is mounted in the body 3 so that its axis coincides with the well axis and oriented so that its outlet hole reduces upwardly. It forms a high-speed flow of the formation fluid. The Venturi tubes 6 are arranged above the nozzle 5 coaxial with it so as to provide a rarefaction causing forced liberation of gas which is dissolved in the formation liquid, so as to produce a finely-dispersed gas-liquid flow. The Venturi tubes 6 are installed one over another and aligned. A collet type holder can be used for securing the body 3 of the device to the seat 4 of the well compressor tube 2.

In accordance with the present invention, the device is provided with means for automatic maintaining a bottomhole pressure of the formation fluid higher than a saturation pressure, substantially independently from changes in properties of the formation and the formation fluid. The automatic maintaining means include a valve 7 which is connected by a connecting rod 8 with a piston 9. The piston 9 is arranged displacedly in a cylinder 10 provided with openings 11 and is spring biased by a spring 12 toward the nozzle 5. The cylinder 10 can be connected with the nozzle 5 by a coupling 13 provided with through-going openings 14. As can be seen from FIG. 1, the valve member 7 has an outer conical surface, while the nozzle 5 has an inner conical surface, defining an inner conical opening in which the valve member 7 is located.

The method in accordance with the present invention is performed and the device in accordance with the present invention operates as follows:

When the well is started, a formation fluid under the action of a pressure difference below and above the device flows from the bottomhole upwardly, passes through the nozzle 5 and forms a high-speed formation fluid so that potential energy of the flow is transformed into kinetic energy, the high-speed flow then passes through the tubes 6 so that its pressure drops and gas dissolved in the formation fluid is liberated in the form of small bubbles so that the formation fluid is transformed into a finely-dispersed gas-liquid flow which, due to expansion of its volume, rises upwardly and moves to the wellhead. During the operation of the well, a column of the formation fluid is formed in the well from a depth of the formation to the location of transformation of the formation fluid into the gas-liquid flow, while a column of the finely-dispersed gas-liquid flow with a liberated gas is formed in the well between the location of transformation and the wellhead of the well. During this process, the formation fluid pressure at the bottomhole has to be maintained above the saturation pressure to prevent clogging pores of the formation with gas, and the speed of the formation fluid has to be maintained high enough to permit its transformation into the gas-liquid flow.

However, when the formation fluid pressure in the formation is reduced, this can lead in known methods to the drop in the bottomhole pressure below the saturation pressure, and also to a decrease in the speed of the formation fluid flow. At the same time, in the inventive device when the pressure in the formation reduces, the spring 12 is relaxed, and the connection rod 8 together with the valve member 7 is displaced upwardly toward the nozzle 5. Thereby the space between the inner conical surface of the nozzle 5 and the outer conical surface of the valve member 7 is reduced and the throughflow cross section of the gap between these conical surfaces is reduced as well. As a result, the formation fluid pressure at the bottomhole is maintained substantially the same and at a higher level than the saturation pressure, and the speed of the formation fluid flow in the nozzle 5 increases so that in the Venturi tubes 6 required conditions are maintained for producing the gas-liquid flow and its movement to the wellhead.

The force liberation of a gas dissolved in the formation oil which is performed by throttling, as explained hereinabove, is based on the following conditions. It is admitted as given that the bottomhole zone pressure $P_{bh}$ is higher than the saturation pressure $$P_{bh}>P_{sat}$$

and the well fluid is uniform, non-compressible liquid, $$\rho_l+\rho_w\beta+\rho_o(1-\beta)=\text{const}=\rho, \text{ wherein}$$

$\rho_l,\rho_w>\rho_o$—density of liquid, water and oil, and $\beta$ is oil content.

When the liquid flows from the narrowing nozzle 5 into the first Venturi tube 6, the following condition of Bernoulli equation must be maintained.

$$P_1+\rho v_1^2/2=P_2+\rho v_2^2/2 \quad (1),$$

wherein $P_1$ and $P_2$ is the pressure before and after the Venturi tube, and $v_1$ and $v_2$ is speed of the flow and after the tube. A portion of the static pressure of potential energy will be converted into dynamic pressure of kinetic energy. This will occur because of the substantial change in a narrowing of the passage cross section. During this process, the law of mass preservation must be maintained in case of non-compressible liquid in accordance with the following formula:

$$\rho_1 v S_1=\rho_2 v_2 S_2$$

$$v_1 S_1=v S_2=q$$

as $\rho_1\sim\rho_2$;

wherein q is a volume liquid rate, $S_1$—is a cross section of the passage before the device, and $S_2$ is a cross section of the Venturi tube.

In order to provide an active liberation of the gas, it is necessary that the pressure in the first Venturi tube be:

$$P_2<P_{sat} \quad (2)$$

By introducing this into formula (1) and the following formula is obtained:

$$P_2=P_1-(\rho/2)(q^2/S_1^2)((S_1/S_2)^2-1) \quad (3)$$

From the formulas (2) and (3) it is possible to calculate the cross section of the first Venturi tube to satisfy the condition of the formula (2) and therefore the condition of gas liberation in the tube.

A considerable reduction of the passage cross section leads to an increase of pressure losses in it in accordance with the following formula:

$$\Delta P_{tb}=L_1\lambda\rho v_2/2D_1 \quad (4)$$

wherein $\lambda$ is a friction coefficient dependent on the Reynolds number, $D_1$ is the diameter of the first Venturi tube, and $L_1$, is the length of the first Venturi tube. As the pressure losses are connected with the value of the bottomhole pressure $P_{bh},=f(\Delta P_{tb})$, the length of the tube allows to regulate the value of the bottomhole pressure within wide limits, usually $\Delta\rho_{tb}=(100\div1000)$psi.

Therefore, from the formula (4) it is possible to calculate the length $L_1$ of the first tube.

From the first Venturi tube a partially degassed liquid flows into the second Venturi tube with a greater cross sections ($D_2$, $L_2$) in which the speed of the liquid is reduced and the flow of the liquid is stabilized. The cross sections $D_2$ and $L_2$ are calculated from the same physical considerations as $D_1$ and $L_1$, with the gas presence taken into account, or in other words with the condition $\rho\neq$constant.

After the aerated liquid flows out, its speed is further reduced in the well tubing, but, due to the specific flow of multi-phase liquid, the liberated gas dissolves back in the liquid only partially. Therefore, the whole column of fluid from the device to the wellhead becomes aerated and consequently it has a lower density and weight. Potential energy of the dissolved gas converts into kinetic energy and moves the formation of oil in the form of a finely-dispersed gas-liquid flow from the location of the flow transformation to the wellhead.

The above-described principle of operation of the inventive method and device is similar to the principle of operation in the method and the device disclosed in the above-mentioned U.S. patent.

In order to perform the method in accordance with the present invention and to operate the inventive device, the following example of realization of the inventive method is presented hereinbelow.

Figure 3:
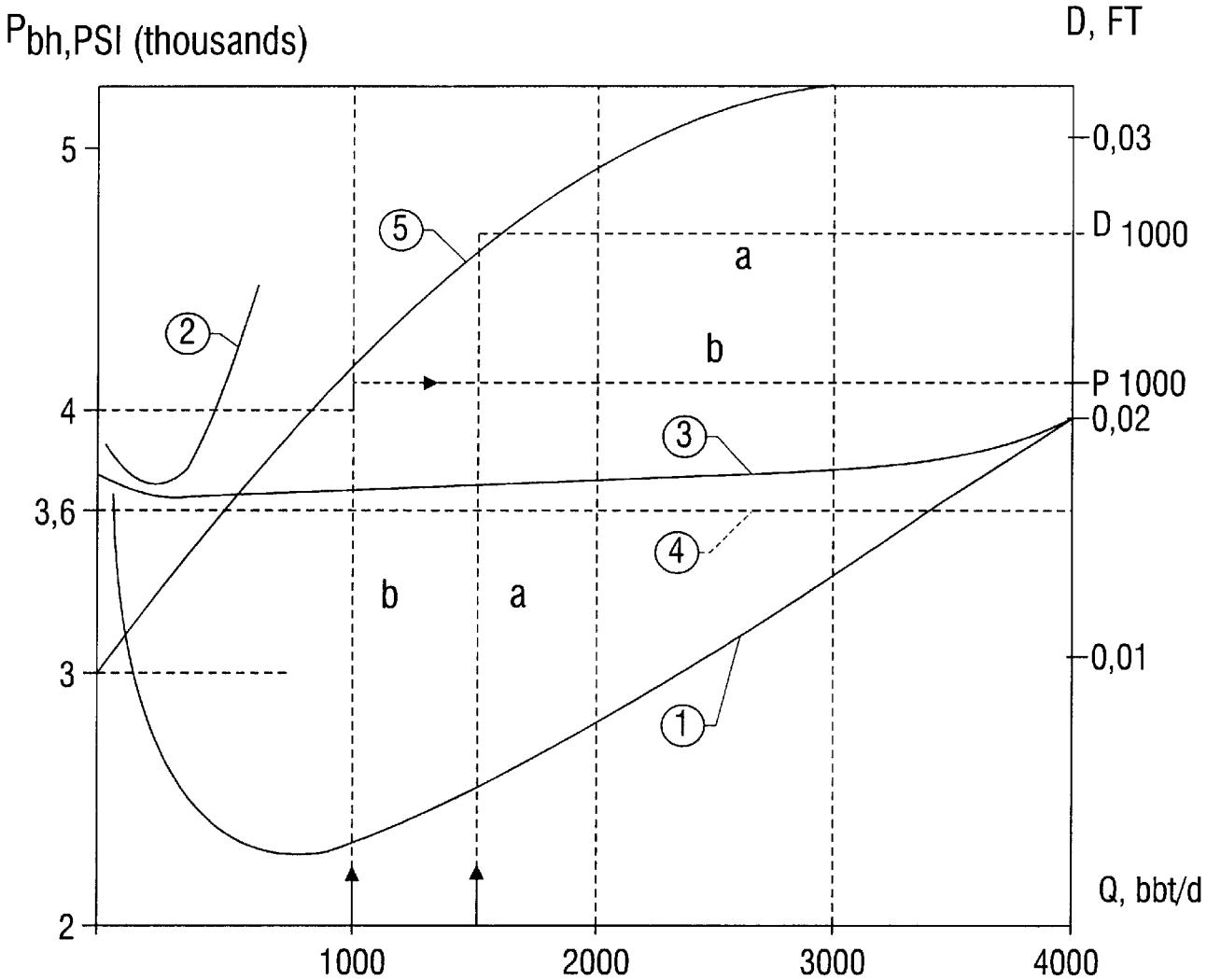
FIG. 3 is a view schematically illustrating operating parameters of a method for production of hydrocarbons in accordance with the present invention, and compared with the existing method.

The inventive method is realized in a well with an inner tubing diameter D=0.166 ft, and a productive formation located at the depth H=12600 ft. Oil has density API=37, and viscosity of the degassed oil $\mu$=2 cPz. Relative density of the gas is equal to 0.78. Water gravity is 1.0. Temperature at the bottomhole is 192°. Gas factor GOR=1300 scf/bbl. Water content in oil WOR=0.23. Pressure at the wellhead is maintained $P_2$=320 psi to prevent well"choking" within the whole range of well productivity 60–3860 bbl/d. The saturation pressure is $P_{sat}$~3580 psi. The main criterion of the efficient well operation is the condition that the bottomhole pressure is greater than saturation pressure: $P_{bh}>P_{sat}$, but this pressure difference must be minimal. With the use of some known methods which deal with a two-phase mixture flowing in vertical pipes, it is possible to calculate a characteristic curve of oil lift, which appears in FIG. 3. The abscissa axis in FIG. 3 defines the range of well productivity from 0 to 4000 barrels per day, the left coordinate axis defines bottomhole pressure or in other words the pressure at the bottomhole of the well within the range 2000–5000 psi, and the curves 1, 2, 3, 4 correspond to this axis, and the right coordinate axis defines a flow cross section of inlet of the nozzle 5 which is being changed by displacement of the valve member 7, and is measured in feet within the range of 0–0.3 feet, this axis corresponds to the characteristic curve 5 in FIG. 3. In FIG. 3 the characteristic curve 1 illustrates a lift operation in a conventional well with which the range of oil productivity 55–3300 barrels per day. The bottomhole pressure is lower than the saturation pressure 3580 psi and therefore the well oil flow substantially reduced, since the bottomhole zone degassing and gas colmatage of the formation occur.

The characteristic curve 2 illustrates the lift operation in the same well if the device disclosed in the above-mentioned U.S. patent installed in it. In this case the well will work in almost the most optimal flow regime within the range of oil productivity of 200–280 barrels per day, with the constant diameter of the inlet of approximately 0.009 ft. In the event that oil productivity increases or decreases beyond the said range, the bottomhole pressure sharply increases, which leads to drop in differential pressure and a failure in optimal well flow regime.

The characteristic curve 3 illustrates the lift according to the inventive method with the inventive device installed in the well, in which device the valve member 7 is arranged inside the nozzle 5 and moves relative to the nozzle in dependence of the fluctuations of the fluid pressure in the formation. The diameter of the inlet between the valve member 7 and the nozzle 5 is automatically regulated in accordance it the characteristic curve 5, and as a result the fluid pressure at the bottomhole is maintained practically constant at the level of approximately 3730 psi, or somewhat higher than the saturation pressure of 3580 psi, within the whole range of oil productivity, from 0 up to 4000 barrels per day.

The characteristic line 4 is a straight line which corresponds to the saturation pressure equal to 3580 psi.

The characteristic line 5 shows the required change of the diameter of the inlet of the nozzle 5 by means of the valve member 7 to suit the changes in oil inflow to the well. The right coordinate axis in FIG. 3 corresponds only to this curve.

As can be seen from the FIG. 3, the condition of optimization will be satisfied provided that the well productivity Q<55 bbl/d, and Q>3300 bbl/d. Using formulas (1), (2), (3), (4) it is possible to calculate the parameters of the device $D_1$, and $L_1$, to maintain the condition in accordance with the formula (1), and the parameters of active degassing of the fluid immediately above the device $D_1$=0.009 ft and $L_1$=0.2 ft. The device will maintain the conditions within a small interval of oil productivity 200<Q<280 bbl/d, according to the curve 2 in FIG. 3. In a similar manner, as for Q=240 bbl/d, can be calculated the change in the diameter of the inlet of the Venturi tube to satisfy the condition (1) within the whole range of the expected well productivity. The results of the calculations are also illustrated in FIG. 3. The characteristic curve 3 is the curve of the lift according to the inventive device when its inlet diameter changes in conformity with the characteristic curve 5. As a result, it is possible to provide a system which has a characteristic curve of lift (FIG. 3) close to the straight line within a broad range of well productivity changes as well as within a broad range of changes of other formation parameters. The condition of optimal operation of the system formation-well $P_{bl}>P_{sat}$ is satisfied, and the difference between them is maintained at a minimal level. Aeration always starts immediately above the device. No choking of the well occurs at the wellhead. A stable operation of the well is provided, as the lift characteristic curve does not have a falling portion.

It may be understood that each of the elements described above, or two or more together, may also find a useful application on other types of constructions and methods differing from the types described above.

While the invention has been illustrated and described as embodied in a method of and device for recovery of hydrocarbons, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A method of production of hydrocarbons from a well having a bottomhole and a wellhead and communicating with a formation, the method comprising the steps of producing a flow of hydrocarbon-containing formation fluid from the formation at the bottomhole of the well; transforming the flow of the formation fluid at a location of transformation into a finely-dispersed gas-liquid flow with a liberated gas forming a part of the gas-liquid flow, so that a column of the formation fluid is formed in the well from the depth of the formation to the location of transformation, and a column of the finely-dispersed gas-liquid flow with a liberated gas is formed in the well between the location of transformation and the wellhead; and maintaining pressure of the formation fluid below the location of transformation higher than saturation pressure by adjusting flow cross-section and speed of flow of the formation fluid near the location of transformation in response to change in pressure of the formation fluid below the location of transformation.

2. A method as defined in claim 1, wherein maintaining pressure of the formation fluid below the location of transformation higher than saturation pressure includes maintaining speed of flow of the formation fluid from the bottomhole to the location of transformation at such a level which insures the transformation of the formation fluid into finely-dispersed gas-liquid flow with the liberated gas.

3. A method as defined in claim 1, wherein the pressure of the formation fluid below the location of transformation is maintained higher than saturation pressure so that the pressure of the formation fluid at the bottomhole is lower than the pressure of the formation fluid in the formation.

4. A method as defined in claim 1, wherein said pressure of the formation fluid below the location of transformation is maintained higher than the saturation pressure at a depth which is lower than the depth of the location of the transformation of the flow of the formation fluid into the finely-dispersed gas-liquid flow with the liberated gas.

5. A method as defined in claim 1, wherein flow cross-section and speed of flow of the formation fluid is adjusted by reducing flow cross-section and increasing speed of flow in response to a pressure decrease of the formation fluid and by increasing flow cross-section and decreasing speed of flow in response to a pressure increase of the formation fluid.

6. A method as defined in claim 1, wherein pressure of a spring and pressure of formation fluid operate to adjust flow cross-section and speed of flow.

7. A device for production of hydrocarbons from a well having a bottomhole and a wellhead and communicating with a formation, the device comprising means for transforming a flow of hydrocarbons-containing formation fluid at a location of transformation into a finely-dispersed gas-liquid flow so that a column of the formation fluid is formed in the well from a depth of the formation to the location of the transformation while a gas-liquid column of the finely-dispersed gas-liquid flow with a liberated gas is formed in the well from the location of transformation to the wellhead; and flow control means for maintaining pressure of the formation fluid below the location of transformation higher than saturation pressure by adjusting flow cross-section and speed of flow of the formation fluid near the location of transformation in response to change in pressure of the formation fluid below the location of transformation.

8. A device as defined in claim 7, in which the flow control means includes a moveable member in relation to a flow passage which reduces flow cross-section of the formation fluid in response to a pressure decrease of the formation fluid, and increases the flow cross-section and reduces the speed of the flow of the formation fluid in response to a pressure increase of the formation fluid.

9. A device as defined in claim 7, wherein said flow control means includes at least one nozzle with a cross section reducing in the vertical upward direction, at least one Venturi tube located immediately above and following said nozzle, and a valve member which is movable in said nozzle under the action of pressure of the formation fluid in the formation so as to adjust the flow cross section between said valve member and said nozzle.

10. A device as defined in claim 7, wherein said flow control means includes an adjustable valve with a mechanical bias toward a limited cross section in the reduction of formation pressure and a piston responsive to fluid pressure operating against the mechanical bias.

11. A device as defined in claim 10, wherein the mechanical bias is a spring.

* * * * *